US006040662A

United States Patent [19]

Asayama

[11] Patent Number: 6,040,662

[45] Date of Patent: Mar. 21, 2000

[54] FLUORESCENT LAMP INVERTER APPARATUS

[75] Inventor: Atsushi Asayama, Yokohama, Japan

[73] Assignee: Canon Kabushiki Kaisha, Tokyo, Japan

[21] Appl. No.: 09/000,882

[22] Filed: Dec. 30, 1997

[30] Foreign Application Priority Data

Jan. 8, 1997 [JP] Japan ..... 9-011871

[51] Int. Cl.[7] ..... G05F 1/00

[52] U.S. Cl. ..... 315/291; 315/307; 315/209 R; 315/278; 363/21; 363/131

[58] Field of Search ..... 315/291, 307, 315/209 R, 224, 225, 94, 101, 105, 106, 276, 278, 282; 363/21, 15–18, 24, 97, 131

[56] References Cited

U.S. PATENT DOCUMENTS 4,980,811 12/1990 Suzuji et al. ..... 363/21
5,491,388 2/1996 Nobuyuki et al. ..... 315/308
5,619,403 4/1997 Ishikawa et al. ..... 363/21
5,627,434 5/1997 Sekiya et al. ..... 315/94
5,748,460 5/1998 Ishikawa ..... 363/21

*Primary Examiner*—Haissa Philogene
*Attorney, Agent, or Firm*—Fitzpatrick, Cella, Harper & Scinto

[57] ABSTRACT

In an inverter apparatus for a fluorescent lamp which is used as an original exposure lamp of a copy machine, a first secondary winding to which a choking coil and the fluorescent lamp are connected in series and a second secondary winding to which a capacitor is connected in series are formed on a secondary side of an inverter transducer, and a switching element for switching whether the first and second secondary windings are connected in series or in parallel and a diode bridge are further provided.

11 Claims, 3 Drawing Sheets

FLUORESCENT LAMP INVERTER APPARATUS

BACKGROUND OF THE INVENTION

1. Field of the Invention

The present invention relates to a fluorescent lamp inverter apparatus.

2. Related Background Art

Conventionally, as a fluorescent lamp inverter apparatus of the type which is provided in a copy machine, a printer or the like to light a fluorescent lamp for illuminating an original and to perform light modulation for such the fluorescent lamp is known. FIG. 4 is a circuit block diagram showing the structure of the conventional fluorescent lamp inverter apparatus. In this fluorescent lamp inverter apparatus, a choking coil L2*a* is provided to restrict a current flowing in a fluorescent lamp FL1*a*. Further, the number of turns of a secondary winding n2*a* of an inverter transformer T1*a* is set such that a secondary-side output voltage becomes larger than a lighting start voltage Vth of the fluorescent lamp FL1*a*. Furthermore, when switching elements SW1*a* and SW2*a* connected to primary windings n11*a* and n12*a* of the inverter transformer T1*a* are driven in a push-pull mode, the output voltage of a rectangular wave is generated at the secondary winding n2*a*.

When a peak-to-peak (P—P) value of this rectangular-wave output voltage is larger than the lighting start voltage Vth of the fluorescent lamp FL1*a*, the fluorescent lamp FL1*a* lights. Because of a characteristic of the fluorescent lamp FL1*a*, its impedance |Z| before the lighting has a significantly high value but the impedance |Z| after the lighting has a relatively small value. Therefore, a discharge current (tube current) after the lighting has a value which is determined by the P—P value and a frequency of the rectangular-wave output voltage and impedance of the choking coil L2*a*.

A diode bridge DB1*a* and a switching element SW3*a* for the light modulation are connected to both ends of the fluorescent lamp FL1*a* of the secondary winding n2*a*. A light modulating circuit 18*a* controls duty ratio of on/off of the switching element SW3*a* by using a driving signal to perform the light modulation for the fluorescent lamp FL1*a*. Further, a preheating circuit 13*a* controls a preheating voltage applied to a filament of the fluorescent lamp FL1*a*.

However, the above-described conventional fluorescent lamp inverter apparatus has a following problem. That is, take notice of the choking coil L2*a*. When the fluorescent lamp FL1*a* is in the lighting state, a voltage substantially equal to the lighting start voltage Vth of the fluorescent lamp FL1*a* is being applied to the choking coil L2*a*. Thus, as an inductance value of the choking coil L2*a*, the sufficiently large inductance value is required to set the tube current of the fluorescent lamp FL1*a* having a desired value.

Generally, the lighting start voltage of the fluorescent lamp used in the copy machine or the like for illuminating the original is about several hundreds volts (V) (P—P value), the tube current is about several hundreds amperes (A), and an oscillation frequency is about 20 KHz. Therefore, it is required the choking coil of which inductance is about 20 mH (milli-henry), current value is about several hundreds milli-amperes, and winding withstanding voltage is about several hundreds volts. For this reason, the fluorescent lamp inverter apparatus which contains the choking coil satisfying such a specification becomes extremely large in size and high in cost.

In consideration of this problem, the applicant of the present application previously proposed a fluorescent lamp inverter apparatus having two choking coils. FIG. 5 is a circuit block diagram showing the structure of the fluorescent lamp inverter apparatus having the two choking coils. One of the two-divided choking coils is a high-withstanding-voltage and low-current choking coil L3*b* which is provided on a secondary winding to start lighting of a fluorescent lamp FL1*b*, and the other is a low-withstanding-voltage and high-current choking coil L2*b* which is provided on the secondary winding to maintain a tube current.

In order to shift a state of this fluorescent lamp inverter apparatus from a non-lighting state to a lighting state, while a switching element SW3*b* is in an off state, primary windings n11*b* and n12*b* of an inverter transformer T1*b* are driven by a switching elements SW1*b* and SW2*b* in a push-pull mode. At that time, a rectangular-wave output voltage is generated on secondary windings n2*b* and n3*b* of the inverter transformer T1*b* according to their winding ratio.

Since the switching element SW3*b* is in the off state, a loop (secondary winding n2*b* choking coil L2*b* fluorescent lamp FL1*b* secondary winding n3*b* choking coil L3*b* secondary winding n2*b*) is formed. The output voltage generated on the secondary windings (n2+n3) is applied to the fluorescent lamp FL1*b*. When the applied voltage is equal to or higher than a lighting start voltage Vth, the tube current restricted by the choking coils (L2+L3) flows in the fluorescent lamp FL1*b*.

When the switching element SW3*b* is turned on in the state that the tube current is flowing, two loops respectively containing the secondary windings n2*b* and n3*b* are formed. In the one loop (secondary winding n3*b*→choking coil L3*b*→switching element SW3*b*→secondary winding n3*b*), a reactive current flows. In the other loop (secondary winding n2*b*→choking coil L2*b*→fluorescent lamp FL1*b*→switching element SW3*b*→secondary winding n2*b*), the tube current flows.

Since a tube voltage of the fluorescent lamp FL1*b* is sufficiently lower than the lighting start voltage Vth during the lighting of the fluorescent lamp, the number of turns of the secondary winding n2*b* is set such that the voltage generated on the secondary winding n2*b* has a value sufficiently lower than the lighting start voltage Vth and inductance of the choking coil L2*b* has a sufficiently low value, whereby the desired tube current can be obtained. Further, since only the voltage which is generated on the secondary winding n2*b* and sufficiently lower than the lighting start voltage Vth is applied to the choking coil L2*b*, the withstanding voltage can be designed to be low.

On the other hand, the number of turns of the secondary winding n3*b* is set such that such the number is sufficiently larger than the number of turns of the secondary winding n2*b* and the voltage generated on the secondary windings (n2+n3) has the value higher than the lighting start voltage Vth, whereby the lighting of the fluorescent lamp can be assured. Therefore, by setting the choking coil L3*b* having the sufficiently large inductance, even if the tube current at the lighting start time merely has the value sufficiently smaller than that of the desired tube current, the fluorescent lamp is lighted.

That is, such the fluorescent lamp inverter apparatus has a system in which the fluorescent lamp is initially lighted darkly and then lighted brightly by turning on the switching element SW3*b*.

The reactive current in the loop (secondary winding n3*b*→choking coil L3*b*→switching element SW3*b* →secondary winding n3*b*) on the side of the secondary winding n3*b* can be ignored as a whole, because the choking coil L3*b* is set to have the large inductance. In this case, before the fluorescent lamp is lighted, it is necessary to sufficiently heat its filament by a preheating circuit 13*b*.

In such the conventional fluorescent lamp inverter apparatus using the two choking coils, since the choking coil L3*b* which is used in the loop to assure the lighting of the fluorescent lamp is the high-withstanding-voltage, high-inductance and low-current coil, its size became inevitably large.

SUMMARY OF THE INVENTION

An object of the present invention is to provide a fluorescent lamp inverter apparatus which eliminates the above-described drawbacks.

Another object of the present invention is to provide a fluorescent lamp inverter apparatus which can be reduced in size and cost by using a capacitor instead of a choking coil.

The above objects, features, and advantages of the present invention will be apparent from the following detailed description and the appended claims in conjunction with the accompanying drawings.

DETAILED DESCRIPTION OF THE PREFERRED EMBODIMENTS

Figure 1:
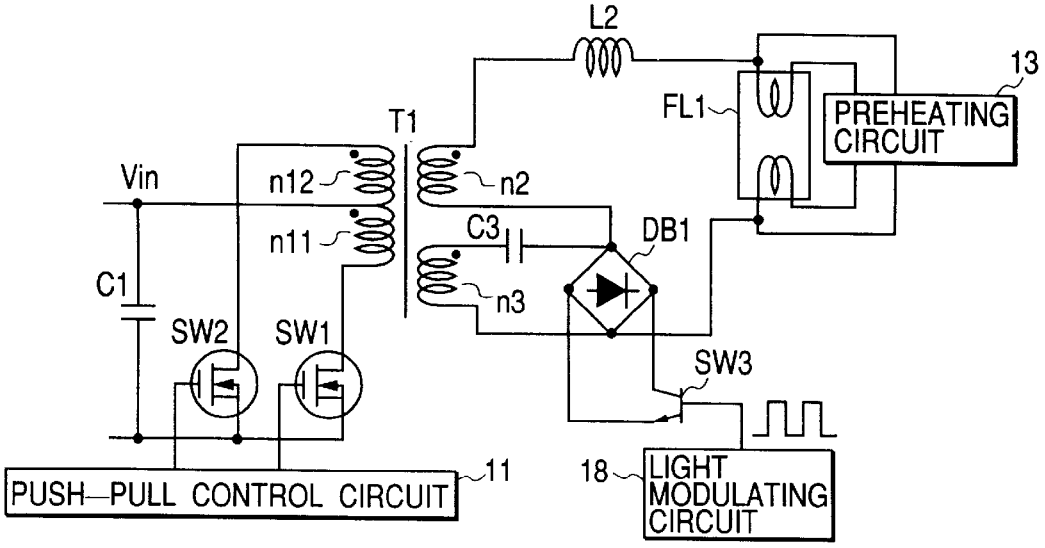
FIG. 1 is a circuit block diagram showing the structure of a fluorescent lamp inverter apparatus according to a first embodiment of the present invention.

The embodiment of a fluorescent lamp inverter apparatus according to the present invention will be explained. FIG. 1 is a circuit block diagram showing the structure of the fluorescent lamp inverter apparatus according to the first embodiment. In the drawing, reference symbol T1 denotes an inverter transformer for lighting a fluorescent lamp FL1.

A primary winding n1 of the inverter transformer T1 is divided into two primary windings n11 and n12 by means of a center tap, and the center tap is connected to a power-supply voltage Vin. Further, ends of the primary winding nl are connected to drains of switching elements SW1 and SW2 (field effect transistors: FET) respectively, and sources of the elements are grounded.

When the switching elements SW1 and SW2 alternately perform switching in a push-pull mode, a voltage is generated on secondary windings n2 and n3 according to their winding ratio. One end of the secondary winding n2 is connected to one end of the fluorescent lamp FL1 through a choking coil L2, and the other end of the secondary winding n2 is connected to one input terminal of a diode bridge DB1. Further, one end of the secondary winding n3 is connected to the one input terminal of the diode bridge DB1 through a capacitor C3 as well as the secondary winding n2, and the other end of the secondary winding n3 is connected to the other input terminal of the diode bridge DB1 and the other end of the fluorescent lamp FL1.

An anode and a cathode of the diode bridge DB1 are connected between a collector and an emitter of an NPN transistor acting as a switching element SW3. Thus, an alternate current (AC) switching circuit is formed by the diode bridge DB1 and the switching element SW3.

Further, a push-pull control circuit 11 is connected to gates of the FETs respectively constructing the switching elements SW1 and SW2; a preheating circuit 13 is connected to both ends of the fluorescent lamp FL1; and a light modulating circuit 18 to output a driving signal is connected to a base of an NPN transistor acting as the switching element SW3.

Subsequently, operations of the fluorescent lamp inverter apparatus will be explained according to two cases, i.e., in one case the switching element SW3 is in an off state, and in the other case the switching element SW3 is in an on state.

Initially, in the case where the switching element SW3 is in the off state, it is set in a state wherein the choking coil L2, the capacitor C3 and the fluorescent lamp FL1 are connected to the secondary windings (n2+n3) in series. In this case, an oscillating frequency of the fluorescent lamp inverter apparatus is set such that impedance of the capacitor C3 is sufficiently larger than impedance of the choking coil L2. Therefore, when the choking coil L2 and the capacitor C3 are connected in series, its impedance becomes substantially equal to the impedance of the capacitor C3. Namely, it is set in a state wherein the fluorescent lamp FL1 is connected to the secondary windings (n2+n3) through the capacitor C3.

Further, in the case where the switching element SW3 is in the off state, when the number of turns of the secondary windings (n2+n3) is selected such that an output voltage Voff on the secondary windings represented by an equation (1) is larger than a fluorescent lamp lighting start voltage Vth, the fluorescent lamp FL1 starts discharging. In this case, a discharging current Ioff has a value represented by an equation (2).

$$Voff=Vin\times(n2+n3)/n1 \quad (1)$$

$$Ioff\cong Voff\times j\omega\times C3 \quad (2)$$

On the other hand, in the case where the switching element SW3 is in the on state, loops a and b are formed. In the loop a, the choking coil L2 and the fluorescent lamp FL1 are connected to the secondary winding n2 in series. In the loop b, the secondary winding n3 is short-circuited through the capacitor C3. If the loop b is applied to the primary side, it can be obtained an equivalent circuit in which a capacitor C3' represented by an equation (3) is connected to the primary windings n1 in parallel.

$$C3'=C3\times(n3/n1)^2 \quad (3)$$

Further, in the case where the switching element SW3 is in the on state, even if an output voltage Von represented by an equation (4) is smaller than the lighting start voltage Vth of the fluorescent lamp FL1, the fluorescent lamp FL1 continues discharging after the switching element SW3 is turned off. In this case, a discharging current Ion has a value represented by an equation (5).

$$Von=Vin\times n2/n1 \quad (4)$$

$$Ion \cong Von/(j\omega \times L2) \quad (5)$$

For example, it is assumed that the number of turns of the secondary winding n2 is "n", the number of turns of the secondary winding n3 is "3×n", the impedance of the choking coil L2 is "Z", and the impedance of the capacitor C3 is "20×Z", for simplicity.

In the case where the switching element SW3 is in the off state, when the fluorescent lamp FL1 starts discharging, the discharging current Ioff has a value represented by an equation (6).

$$Ioff \cong Voff \times (j\omega \times C3) = 4 \times Vin \times (j\omega \times C3) \times n/n1 = 4 \times Vin \times n/n1/(20 \times Z) = 1/5 \times (Vin \times n/n1/Z) \quad (6)$$

On the other hand, in the case where the switching element SW3 is in the on state, while the discharging is continued, the discharging current Ion has a value represented by an equation (7).

$$Ion \cong Von/(j\omega \times L2) = Vin \times n/n1/(j\omega \times L2) = Vin \times n/n1/Z = 1 \times (Vin \times n/n1/Z) \quad (7)$$

That is, when the switching element SW3 is once turned off to light the fluorescent lamp FL1, the five-times discharge current can be obtained by turning on the switching element SW3. Also, by alternately repeating the turning on and off of the switching element SW3 at a frequency of about several kilohertz (KHz) and controlling respective time ratio, the fluorescent lamp can be light modulated.

Figure 4:
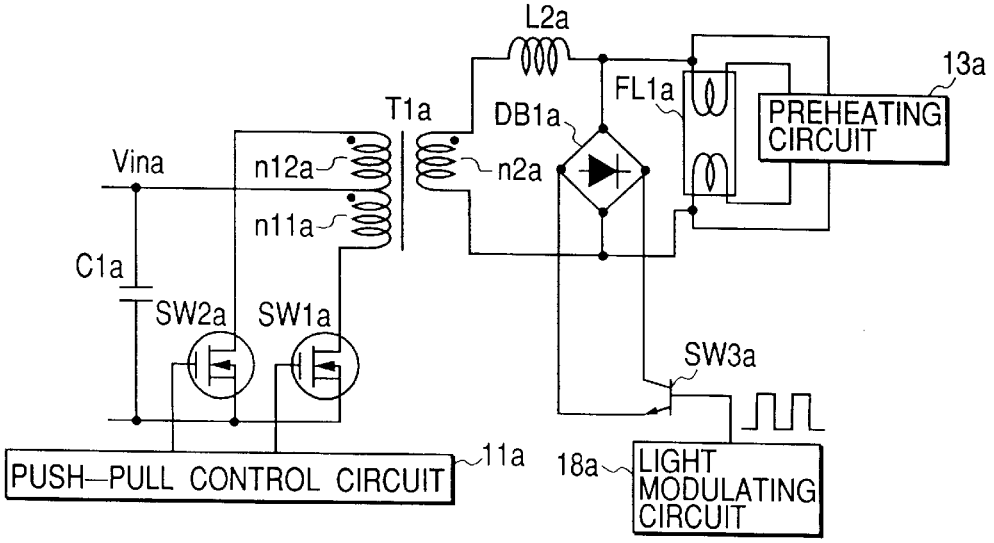
FIG. 4 PRIOR ART
FIG. 4 is a circuit block diagram showing the structure of a conventional fluorescent lamp inverter apparatus.

A case when the first embodiment is compared with the previously-explained prior art of the fluorescent lamp inverter apparatus will be explained hereinafter. In the conventional fluorescent lamp inverter apparatus shown in FIG. 4, in order to obtain the discharge current corresponding to Ion shown in the equation (7), it is necessary to start lighting the fluorescent lamp with the number of turns of the secondary winding n2*a* as "4×n", and to set the impedance of the choking coil L2*a* as "4×Z". Therefore, it is necessary for the choking coil L2*a* have the inductance of required specifics, i.e., impedance "4×Z", withstanding voltage "4×(Vin×n/n1)" and current capacity "Ion".

Figure 5:
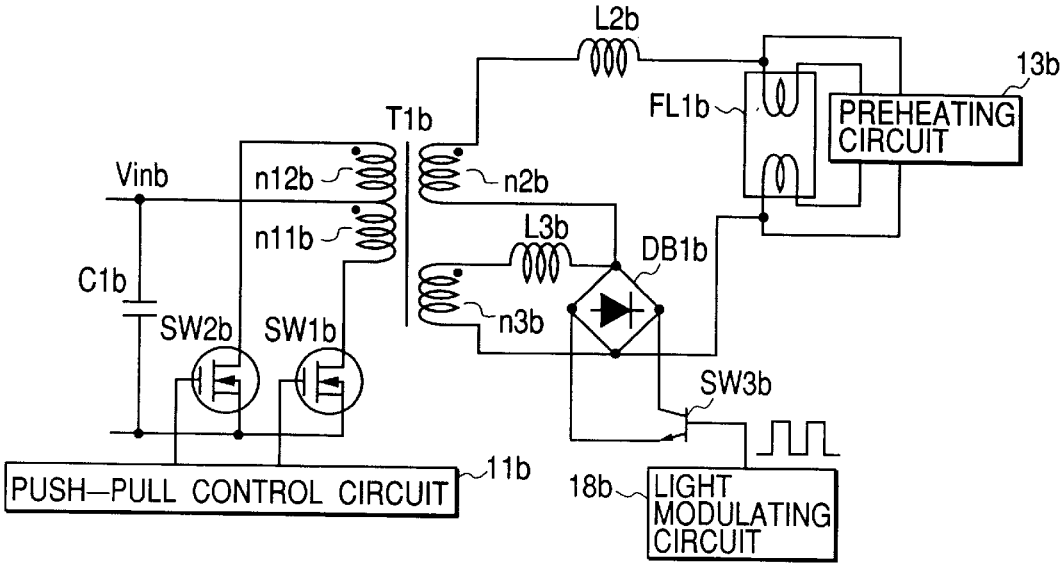
FIG. 5 PRIOR ART
FIG. 5 is a circuit block diagram showing the structure of a fluorescent lamp inverter apparatus having two choking coils.

In the fluorescent lamp inverter apparatus shown in FIG. 5, it is necessary to start lighting the fluorescent lamp with the number of turns of the secondary windings n2*b* and n3*b* respectively as "n" and "3×n". Further, it is necessary for the choking coil L2*b* to have the inductance of impedance "Z", withstanding voltage "(Vin×n/n1)" and current capacity "Ion", and for choking coil L3*b* to have the inductance of impedance "20×Z", withstanding voltage "3×(Vin×n/n1)" and current capacity "Ion×4/21".

As explained above, in the fluorescent lamp inverter apparatus according to the first embodiment, by using the capacitor C3 consisting of, e.g., a high-voltage ceramic capacitor instead of the choking coil L3*b* shown in FIG. 5, the apparatus itself can be made compact in size and also its cost can be significantly reduced.

Second Embodiments

Figure 2:
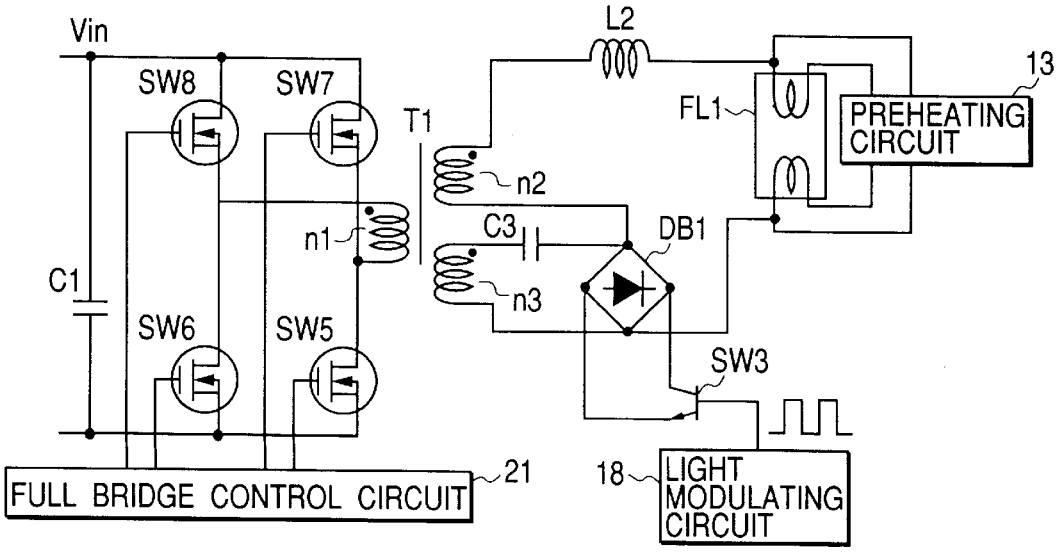
FIG. 2 is a circuit block diagram showing the structure of a fluorescent lamp inverter apparatus according to a second embodiment of the present invention.

FIG. 2 is a circuit block diagram showing the structure of a fluorescent lamp inverter apparatus according to the second embodiment of the present invention. In this fluorescent lamp inverter apparatus, a full bridge control circuit 21 is provided on a primary side of an inverter transformer T1. On the other hand, the structure on a secondary side of the inverter transformer T1 is the same as that in the above-described initial embodiment. In this another embodiment, the switching elements are increased in number, i.e., four. However, each withstanding voltage of switching elements SW5, SW6, SW7 and SW8 is reduced in half. Further, since any center tap on the primary side of the inverter transformer T1 is not necessary, the inverter transformer T1 can be simplified.

Third Embodiment

Figure 3:
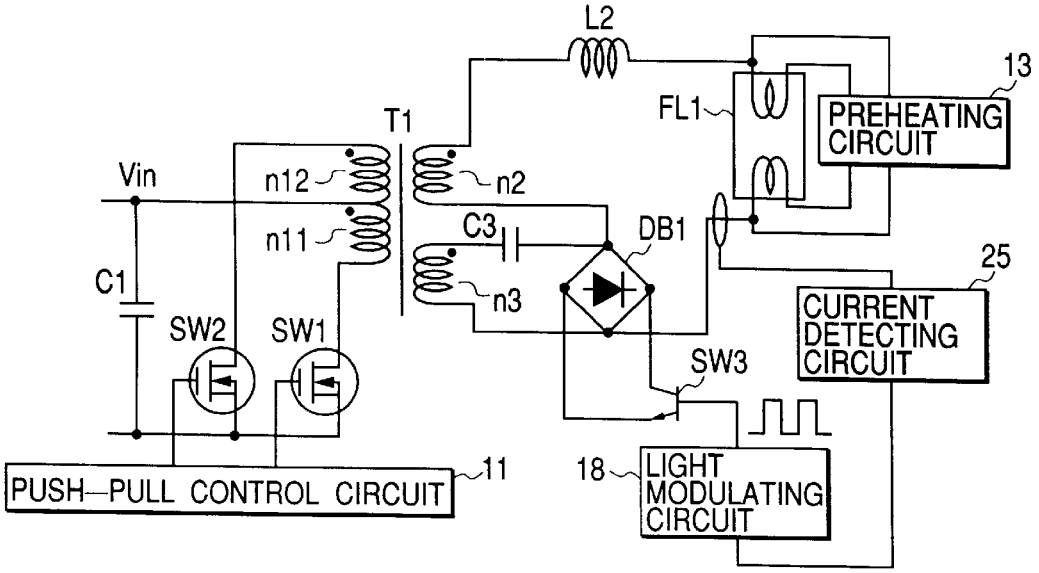
FIG. 3 is a circuit block diagram showing the structure of a fluorescent lamp inverter apparatus according to a third embodiment of the present invention.

FIG. 3 is a circuit block diagram showing the structure of a fluorescent lamp inverter apparatus according to the third embodiment of the present invention. In this fluorescent lamp inverter apparatus, a current detecting circuit 25 to detect a current flowing in a fluorescent lamp FL1 is added on a secondary side of an inverter transformer T1 (T1 being identical with that shown in FIG. 1). In this third embodiment, by turning off a switching element SW3 until a discharge current at lighting start time is detected, and then turning on the switching element SW3 after the discharge current is detected, the lighting starting can be made reliable.

Although the present invention has been explained by the above-described preferred embodiments, the present invention is by no means limited to the embodiments and is subjected to various modifications within the spirit and scope of the appended claims.

What is claimed is:

1. A fluorescent lamp inverter apparatus for lighting a fluorescent lamp, comprising:

a transducer;

a control circuit for driving a primary winding of said transducer;

a choking coil connected to a first secondary winding of said transducer, and connected in series with said fluorescent lamp;

a capacitor connected to a second secondary winding of said transducer; and a switching circuit for switching over connection between said first secondary winding and said second secondary winding, to series connection or parallel connection;

wherein said switching circuit switches over the connection to the series connection or the parallel connection at a frequency lower than a frequency used when said control circuit drives said primary winding.

2. An apparatus according to claim 1, wherein said switching circuit has a diode bridge connected between said first secondary winding and said second secondary winding, and a switching element for driving said diode bridge.

3. An apparatus according to claim 1, wherein said switching circuit switches over the connection between said first secondary winding and said second secondary winding to the series connection at discharge start time of said fluorescent lamp, and switches over the connection between said first secondary winding and said second secondary winding to the parallel connection when a discharge current of said fluorescent lamp is maintained.

4. An apparatus according to claim 1, wherein said control circuit has first and second switching elements connected to said primary winding, and a push-pull control circuit for driving said first and second switching elements.

5. An apparatus according to claim 1, wherein said control circuit has four switching elements bridge-connected to said primary winding, and a full bridge control circuit for driving said four switching elements.

6. A fluorescent lamp inverter apparatus for lighting a fluorescent lamp, comprising:

a transducer;

a control circuit for driving a primary winding of said transducer;

a choking coil connected to a first secondary winding of said transducer, and connected in series with said fluorescent lamp;

a capacitor connected to a second secondary winding of said transducer;

a switching circuit for switching over connection between said first secondary winding and said second secondary winding, to series connection or parallel connection; and a current detecting circuit for detecting currents flowing in said secondary winding, wherein said switching circuit maintains the series connection between said first and second secondary windings until a discharge current at lighting start time of said fluorescent lamp is detected by said current detecting circuit.

7. An apparatus according to claim 6, wherein said, switching circuit has a diode bridge connected between said first secondary winding and said second secondary winding, and a switching element for driving said diode bridge.

8. An apparatus according to claim 6, wherein said switching circuit switches over the connection between said first secondary winding and said second secondary winding to the series connection at discharge start time of said fluorescent lamp, and switches over the connection between said first secondary winding and said second secondary winding to the parallel connection when a discharge current of said fluorescent lamp is maintained.

9. An apparatus according to claim 6, wherein said control circuit has first and second switching elements connected to said primary winding, and a push-pull control circuit for driving said first and second switching elements.

10. An apparatus according to claim 6, wherein said control circuit has four switching elements bridge-connected to said primary winding, and a full bridge control circuit for driving said four switching elements.

11. A fluorescent lamp inverter apparatus for lighting a fluorescent lamp, comprising:

a transducer;

a control circuit for driving a primary winding of said transducer;

first and second elements for limiting a tube current of said fluorescent lamp, said first element being connected to a first secondary winding of said transducer and connected to said fluorescent lamp in series, and said second element being connected to a second secondary winding of said transducer;

a switching circuit for switching over connection between said first secondary winding and said second secondary winding, to series connection or parallel connection; and a current detection circuit for detecting currents flowing in said secondary winding, wherein said switching circuit maintains the series connection between said first and second secondary windings until a discharge current at lighting start time of said fluorescent lamp is detected by said current detecting circuit.

* * * * *

UNITED STATES PATENT AND TRADEMARK OFFICE

CERTIFICATE OF CORRECTION

PATENT NO. : 6,040,662
DATED : March 21, 2000
INVENTOR(S) : Atsushi Asayama

It is certified that error appears in the above-identified patent and that said Letters Patent is hereby corrected as shown below:

Column 1,
Line 12, “such the” should read -- such --.
Line 59, “required” should read -- required of --.
Line 59, “of which” should read -- that --.

Column 2,
Line 4, “two-divided” should read -- two divided --.
Line 14, “by a” should read -- by --.
Line 20, “n2b” should read -- n2b→ --, and “L2b” should read -- L2b→ --.
Line 21, “FL1b” should read -- FL1b→ --, and “n3b” should read -- n3b→ --.
Lines 50 and 60, “such the” should read -- such --.

Column 3,
Line 5, “such the” should read -- such --.

Column 4,
Line 53, “it can” should read -- there can --.

Column 5,
Line 59, “EMBODIMENTS” should read -- EMBODIMENT --.

Column 6,
Line 1, “another” should read -- second --.
Line 4, “in half.” should read -- by half. --.

UNITED STATES PATENT AND TRADEMARK OFFICE

CERTIFICATE OF CORRECTION

PATENT NO. : 6,040,662
DATED : March 21, 2000
INVENTOR(S) : Atsushi Asayama

It is certified that error appears in the above-identified patent and that said Letters Patent is hereby corrected as shown below:

Column 7,
Line 20, "said," should read -- said --.

Signed and Sealed this

Twentieth Day of May, 2003

JAMES E. ROGAN
*Director of the United States Patent and Trademark Office*